US006984113B2

(12) United States Patent
Gai

(10) Patent No.: US 6,984,113 B2
(45) Date of Patent: Jan. 10, 2006

(54) OIL PRESSURE OPERATED PUMP FOR MARINE STEERING GEARS WITH A VALVE SET SHELL WITH VALVES SEPARATELY CAPABLE OF ASSEMBLY WITH THE VALVE HOUSING

(75) Inventor: Giorgio Gai, Casella (IT)

(73) Assignee: Ultraflex S.p.A., Casella (IT)

( * ) Notice: Subject to any disclaimer, the term of this patent is extended or adjusted under 35 U.S.C. 154(b) by 159 days.

(21) Appl. No.: 10/413,185

(22) Filed: Apr. 14, 2003

(65) Prior Publication Data

US 2004/0013540 A1 Jan. 22, 2004

(30) Foreign Application Priority Data

Jul. 16, 2002 (IT) ..... GE2002A0064

(51) Int. Cl.
*F04B 1/12* (2006.01)

(52) U.S. Cl. ..... 417/269; 417/270; 417/297; 417/298; 417/435; 91/420; 60/476; 60/475

(58) Field of Classification Search ..... 417/269, 417/270, 297, 298, 307, 440, 435; 91/499, 91/503, 420; 60/468, 476, 473, 475
See application file for complete search history.

(56) References Cited

U.S. PATENT DOCUMENTS

| | | | | |
|---|---|---|---|---|
| 2,036,748 A | | 4/1936 | Fitzgerald | |
| 2,439,879 A | * | 4/1948 | Allen | 417/269 |
| 2,479,063 A | | 8/1949 | Forsythe | |
| 2,568,897 A | * | 9/1951 | Norelius | 277/353 |
| 2,634,145 A | * | 4/1953 | Monahan | 277/550 |
| 2,838,333 A | | 6/1958 | Wilder et al. | |
| 3,175,509 A | | 3/1965 | Kuze | |
| 3,566,746 A | * | 3/1971 | Harrison | 91/6.5 |
| 3,576,192 A | * | 4/1971 | Wood et al. | 137/102 |
| 3,655,205 A | * | 4/1972 | Petersen | 277/396 |
| 3,747,351 A | * | 7/1973 | Wilkerson et al. | 60/476 |
| 3,857,404 A | * | 12/1974 | Johnson | 137/102 |
| 4,286,432 A | * | 9/1981 | Burrows et al. | 60/404 |
| 4,551,105 A | * | 11/1985 | Hall | 440/61 R |
| 4,754,776 A | | 7/1988 | McKee | |
| 5,146,745 A | | 9/1992 | Doetsch | |

(Continued)

FOREIGN PATENT DOCUMENTS

DE 42 41 418 A 6/1994

*Primary Examiner*—Charles G. Freay
*Assistant Examiner*—Emmanuel Sayoc
(74) *Attorney, Agent, or Firm*—Richard M. Goldberg

(57) ABSTRACT

An oil pressure operated pump for marine steering gears includes a multiple piston oil pressure operated pump controlled by a steering wheel, a valve housing mounted under the pump, a bottom cover closing the valve, the valve housing and the cover each including channels, threaded holes for reciprocal fastening thereof, non-threaded bores for oil pressure connections, a valve set lodged in the valve housing for non-return and adjustment of oil flow, the valve set including a generally parallelepiped shaped tubular shell having a generally external square shape, a central tubular through-hole, and lathe-turned ducts, a double acting oil pressure cylinder including a shaft movable in the central tubular through-hole for controlling a direction of an engine or rudder of a boat, and valves for controlling fluid flow and thereby movement of the shaft.

17 Claims, 4 Drawing Sheets

U.S. PATENT DOCUMENTS 5,163,352 A * 11/1992 Yoshino ..... 91/420
5,289,756 A 3/1994 Kobelt
5,349,818 A 9/1994 McFadyen et al.
5,607,166 A * 3/1997 Gorman ..... 277/436
5,638,679 A * 6/1997 Richards ..... 60/453
5,685,215 A * 11/1997 Jepsen et al. ..... 92/71
5,816,359 A * 10/1998 Gregorio et al. ..... 180/403
RE36,342 E * 10/1999 McFadyen et al. ..... 60/385

* cited by examiner

OIL PRESSURE OPERATED PUMP FOR MARINE STEERING GEARS WITH A VALVE SET SHELL WITH VALVES SEPARATELY CAPABLE OF ASSEMBLY WITH THE VALVE HOUSING

BACKGROUND OF THE INVENTION

Steering gears for boats, usually consisting of an oil pressure operated pump activated by the steering wheel are well known; this steering wheel controls, through its own valve set, all oil pressure operated double acting cylinder, axially acting by its mobile shaft on the direction of the engine or rudder of the boat.

SUMMARY OF THE INVENTION

The valve set of this oil pressure operated pump features essentially two, so-called non-return valves which also control the fluid supply and discharge in the two cylinder chambers features, two relief-valves of the maximum pressure and several channels connecting these valves to the pumping pistons, to the pump tank and to the chambers of the cylinder controlling the direction of the engine and of the rudder of the boat.

This invention specifically concerns the valve set which, in known steering gears, consists of one single machined metal housing in which the lodgment of these valves and the necessary channels form a geometrically complex arrangement with very close tolerances and their machining requires the utilization of numerically controlled multi-axis tooling machines involving very expensive equipments and long working hours.

This invention has the aim to obtain the valve set of the oil pressure operated pump for marine steering gears in a faster and much cheaper way.

According to this invention, the valve set consists of three separate elements which can be easily assembled by suitable junction means, for example by bolts. These three elements are:

the valve housing mounted under the pump, the cover closing the lower end of the valve housing, the valve set lodged in the valve housing.

According to this invention, the valve housing and lower closing cover are obtained by pressure die-casting, preferably in aluminium alloy or zinc alloy or injection moulded in thermoplastic material.

These pressure die-casting or pressure moulded valve housings and lower cover are complete with all their necessary channels and holes for bolt-assembly. Threading of these holes through which to pass the bolts is the only one operation required.

The third element, i.e. the valve set, consists of a set of components lodged in a preferably parallelepiped shaped housing with square section and central through hole. This housing features necessary channels machined on a lathe with motor-driven X-Y-Z tools at a much lower cost than required for machining at the above mentioned job centers.

This solution according to the invention, not only permits to cut the production costs, as already explained before, but also facilitates maintenance of the non-return valves which can be easily replaced, whereas the known valve sets require cumbersome disassembly of its various components with the risk to cause damage to the valve packing.

Furthermore, according to this invention, the pump shaft on which the steering wheel of the boat is keyed, is provided with an easily replaceable seal kept in place on this shaft by a special shaped snug fitting cap to prevent the penetration of dust or water as normally happens with known gaskets. This shaft seal also protects the pump better from being damaged.

BRIEF DESCRIPTION OF THE DRAWINGS

The oil pressure operated pump, according to this invention, is illustrated for exemplification purpose in the enclosed drawings in which.

DETAILED DESCRIPTION

Figure 1:
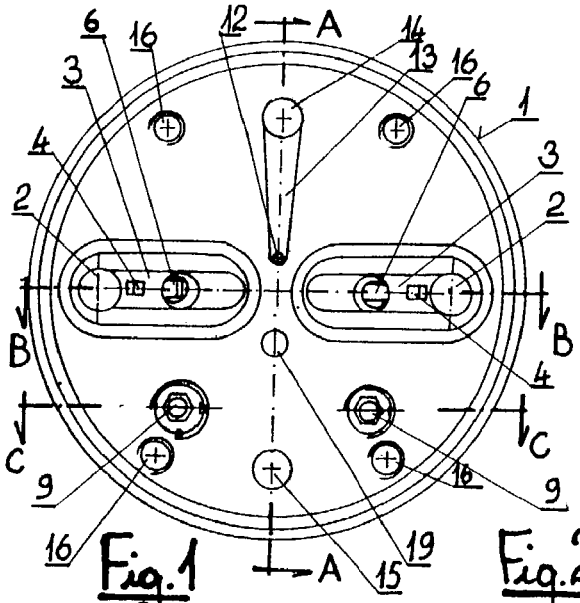
FIG. 1 shows a top view of the valve housing.
Figure 2:
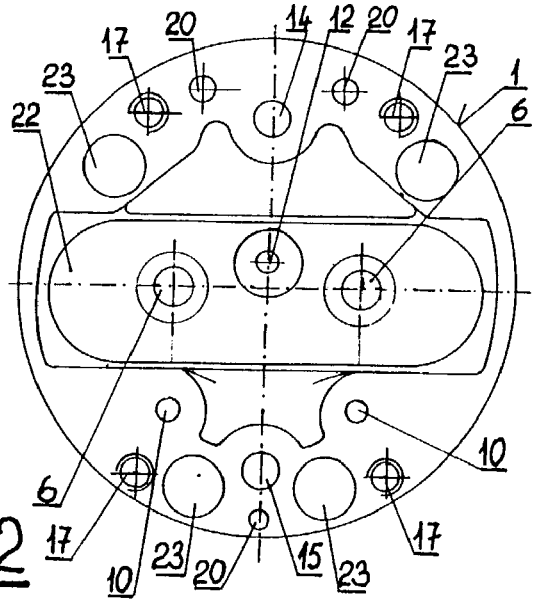
FIG. 2 shows a view from below of the valve housing illustrated in FIG. 1.
Figure 3:
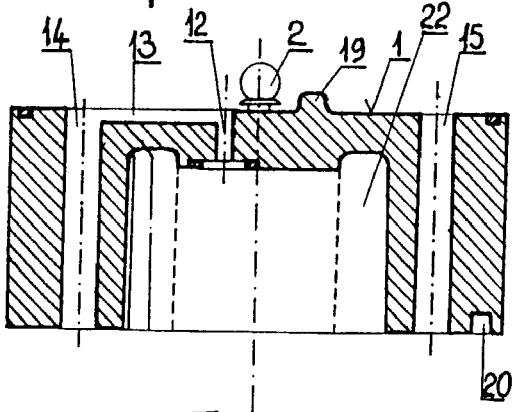
FIG. 3 shows a section of the valve housing according to 3—3 in FIG. 1.
Figure 5:
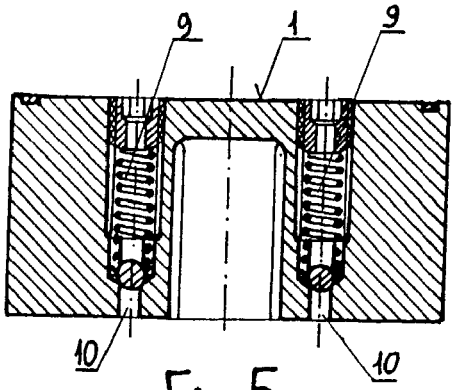
FIG. 5 shows a section of the valve housing according to 5—5 in FIG. 1.
Figure 4:
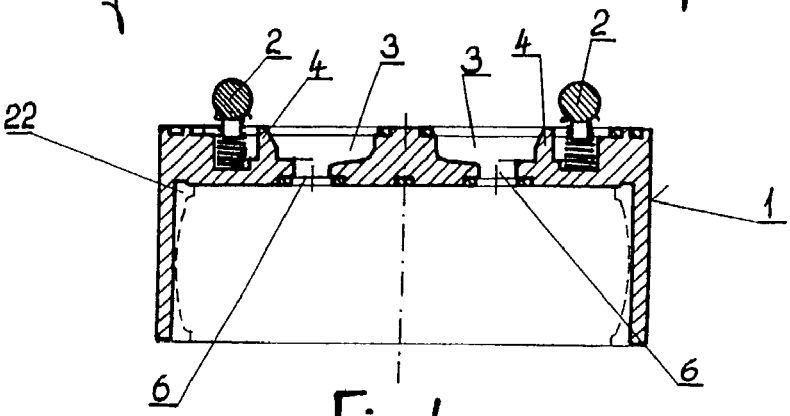
FIG. 4 shows a section of the valve housing according to 4—4 in FIG. 1.
Figure 6:
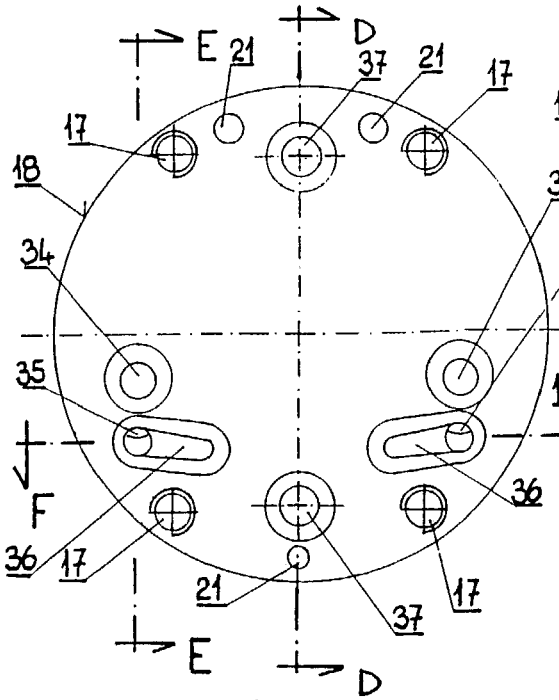
FIG. 6 shows a top view of the cover closing the lower end of the valve housing.
Figure 7:
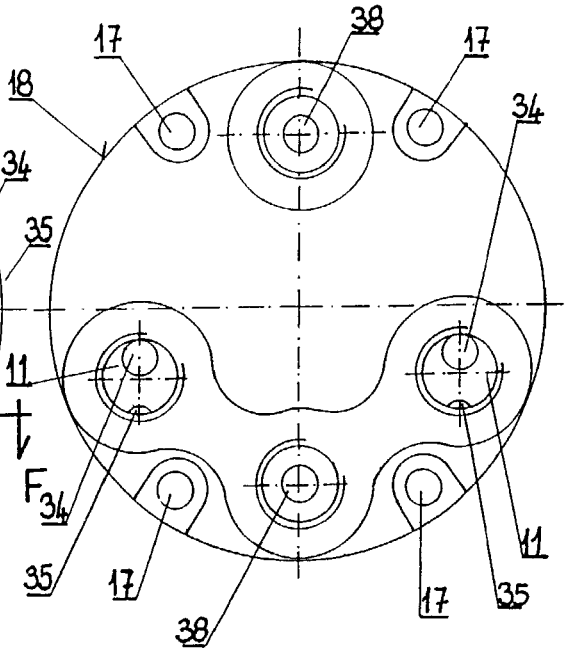
FIG. 7 shows a view from below of the bottom cover in FIG. 6.
Figure 8:
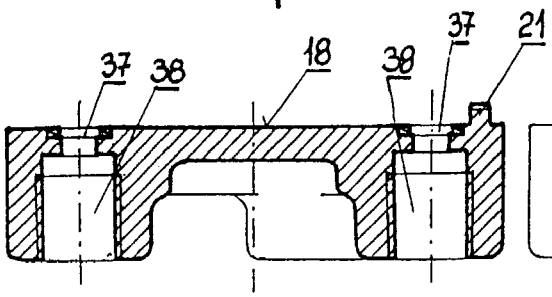
FIG. 8 shows the section of the bottom cover according to 8—8 in FIG. 6.
Figure 9:
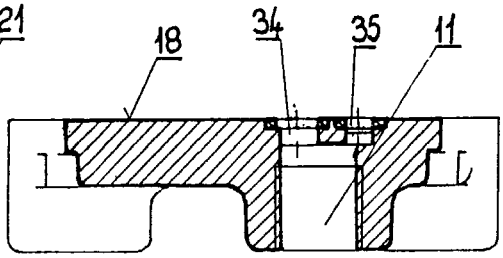
FIG. 9 shows the section of the bottom cover according to 9—9 in FIG. 6.
Figure 10:
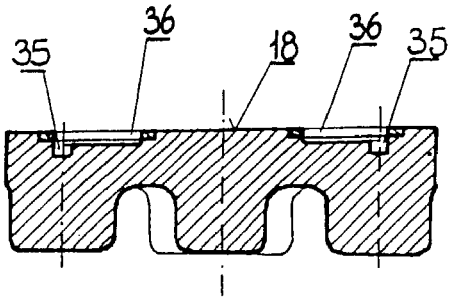
FIG. 10 shows the section of the bottom cover according to 10—10 in FIG. 6.
Figure 11:
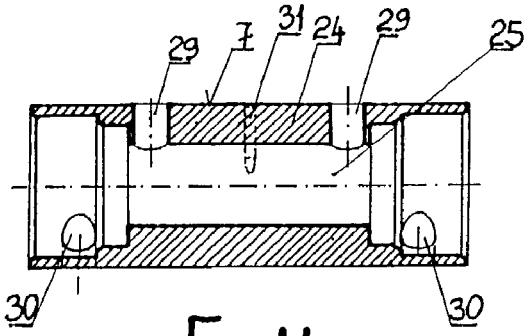
FIG. 11 shows the central longitudinal section of the tubular shell of the set of non-return valves.
Figure 12:
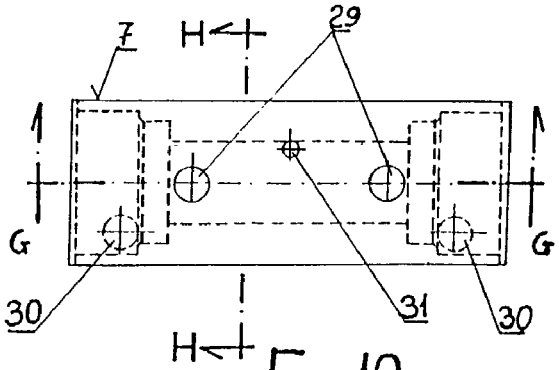
FIG. 12 shows a lateral top view of the tubular shell of the non-return valve set illustrated in FIG. 11.
Figure 13:
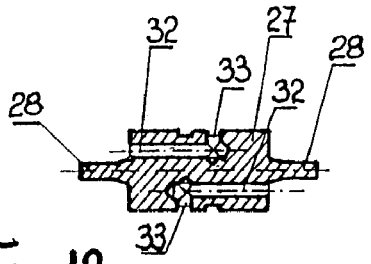
FIG. 13 shows the longitudinal central section of the mobile piston axially controlling the non-return valves.
Figure 15:
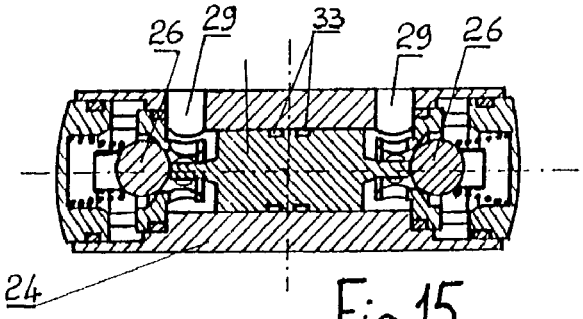
FIG. 15 shows the central longitudinal section according to 15—15 in FIG. 12 of the non-return valve set.
Figure 14:
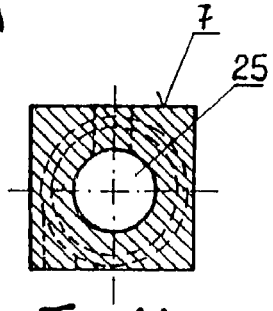
FIG. 14 shows the central cross section according to 14—14 in FIG. 12 of the tubular shell of the non-return valve set.
Figure 17:
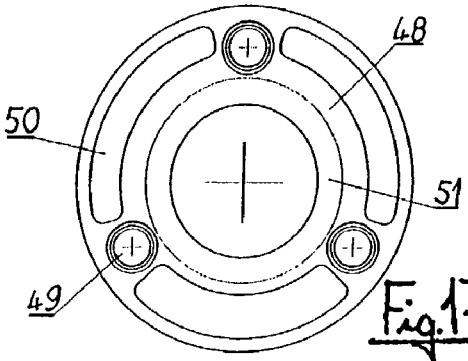
FIG. 17 shows a top view of the, cap blocking the seal on the control shaft of the steering wheel.
Figure 18:
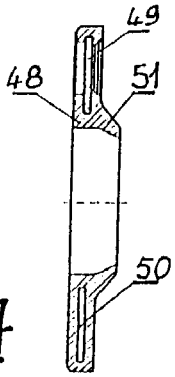
FIG. 18 shows the central vertical section of the cap illustrated in FIG. 17.
Figure 16:
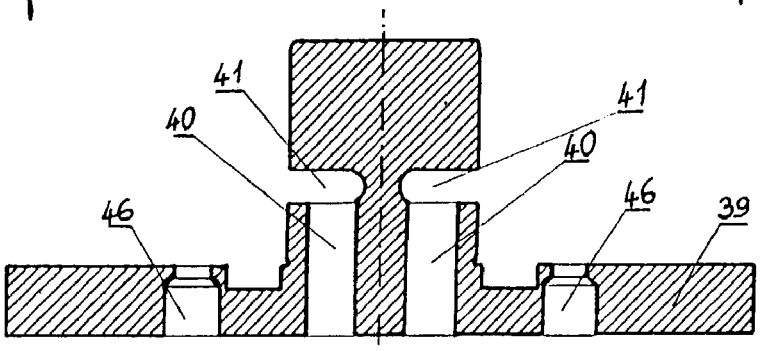
FIG. 16 shows the central vertical section of the bottom flange of the oil pressure operated pump.

With reference to the FIGS. 1 thru 5, 1 shows the valve housing obtained by pressure die-casting, preferable in aluminium alloy or zinc alloy or injection moulded with thermoplastic material. The valve housing features oil its upper surface, two small valves 2 respectively lodged in a recess 3 and each fitted with a tab 4 housing the valve spring. These small valves 2 are located rather peripherally so that they can be connected to the oil tank 5 and they are used to fill the pump with the oil before its utilization and for later topping tip of the pump. The said recesses 3 permit axial shifting of the ducts 6 communicating with the valve set 7 towards the centre of the valve housing 1; these ducts 6 being the suction and compression lines of the oil pump 8, as will be explained hereinafter. Two relief valves 9 are also lodged in the valve housing 1, which relief valves 9 are connected by small channels 10, 35 and branch pipes 11 to the oil pressure operated cylinder chambers as will be explained hereinafter.

The valve housing 1 also features a boring 12 for pressure compensation and balancing of the valve set 7, debouching, through radial recessing 13 of the offset borings, into the pipe 14 connected to the pump tank 5. This branch pipe 14 has also the function, together with a similar pipe 15, if provided, to install two or more oil pressure operated pumps complete with steering wheels located in different parts of the ship.

The top view of the valve housing 1 shows suitably threaded holes 16 to secure the housing 1 by bolting it to the bottom of the pump 8, while the view from below of the valve housing 1 shows threaded holes 17 for fastening the housing by bolting it to the lower cover 18 closing the valve set.

The upper surface of the valve housing 1 also features a dowel 19 for its centering with the lower surface of the pump 8 during assembly, while three blank holes 20, in which to insert the centering dowels 21 for assembly of the lower cover 18, are bored in the outer bottom surface of the valve housing.

A preferably rectangular shaped recess 22 is machined inside the valve housing 1 in which to lodge oiltight the valve set 7 which should also preferably be rectangular shaped.

Internally, the valve housing 1 also features some zones 23 to lighten the structure.

In the FIGS. 11 thru 15, the valve set 7 acts as non-return, supply and discharge valve of the two oil pressure operated cylinder chambers. This valve set 7 features a preferably parallelepiped square section shell 24 with a tubular internal shape 25 in which two ball valves 26 are lodged fitted with the relative thrust/spring and relative seat. Furthermore, a mobile plunger 27 provided with end shanks 28 resting on the balls 26 acting as valves are also mounted in the tubular shell 24. The valves 26 and the relative plunger 27 are acting as non return valves to prevent the fluid from flowing to or from the cylinder chambers when the steering wheel is in rest position and to let the fluid flow to and from the cylinder chambers when the steering wheel is actuated, as will be explained hereinafter.

The delivery or return flow of the pump 8 passes through the valve housing 1 by means of surface machined recesses 3 and ducts 6 and then reaches the axially centred radial ducts 29 of the valve set 7. The delivery or return flow passes through the ball valves 26 to reach the radial ducts 30 which are axially disaligned to save space, and then to reach the bottom cover 18, as explained hereinafter.

The raceway 31 is branched off from the inside 25 of the valve set 7 and is radially disaligned with respect to the centre line of the tubular shell 24 and this raceway 31 is connected to the channel 12 of the valve housing 1, which in turn is connected to the tank 5 of the pump 8.

The above mentioned raceway 31 is also connected to the ducts 32 and circumferential channels 33 of the plunger 27 so as to permit discharging of any overpressure, generated in the valve set 7 and in the hydraulic fluid circuits, into the pump tank 5.

The FIGS. 6 thru 10 show the bottom cover 18 of the valve housing 1 featuring on its upper surface two channels 34 corresponding to the radial and offset ducts 30 of the valve set 7. These channels 34 terminate at the lower surface of the bottom cover 18 with threaded holes 11 branched to the two chambers of the oil pressure operated cylinder. An additional duct 35 is provided adjacent to the said duct 34 inside the hole 11 connecting each cylinder. By means of a surface machined recess 36 by which the ducts are disaligned, the duct 35 is connected to the ducts 10 of the relief valve 9 discharging in the tank 5 of the pump 8. Any overpressure generated in the cylinders and valve set is automatically discharged into the tank of the pump 8 through these relief valves 9.

The bottom cover 18 also features two channels 37 connected to the ducts 14, 15 which in turn are connected by threaded holes 38 to one or more other oil tanks if a multiple steering gear is provided.

Figure 19:
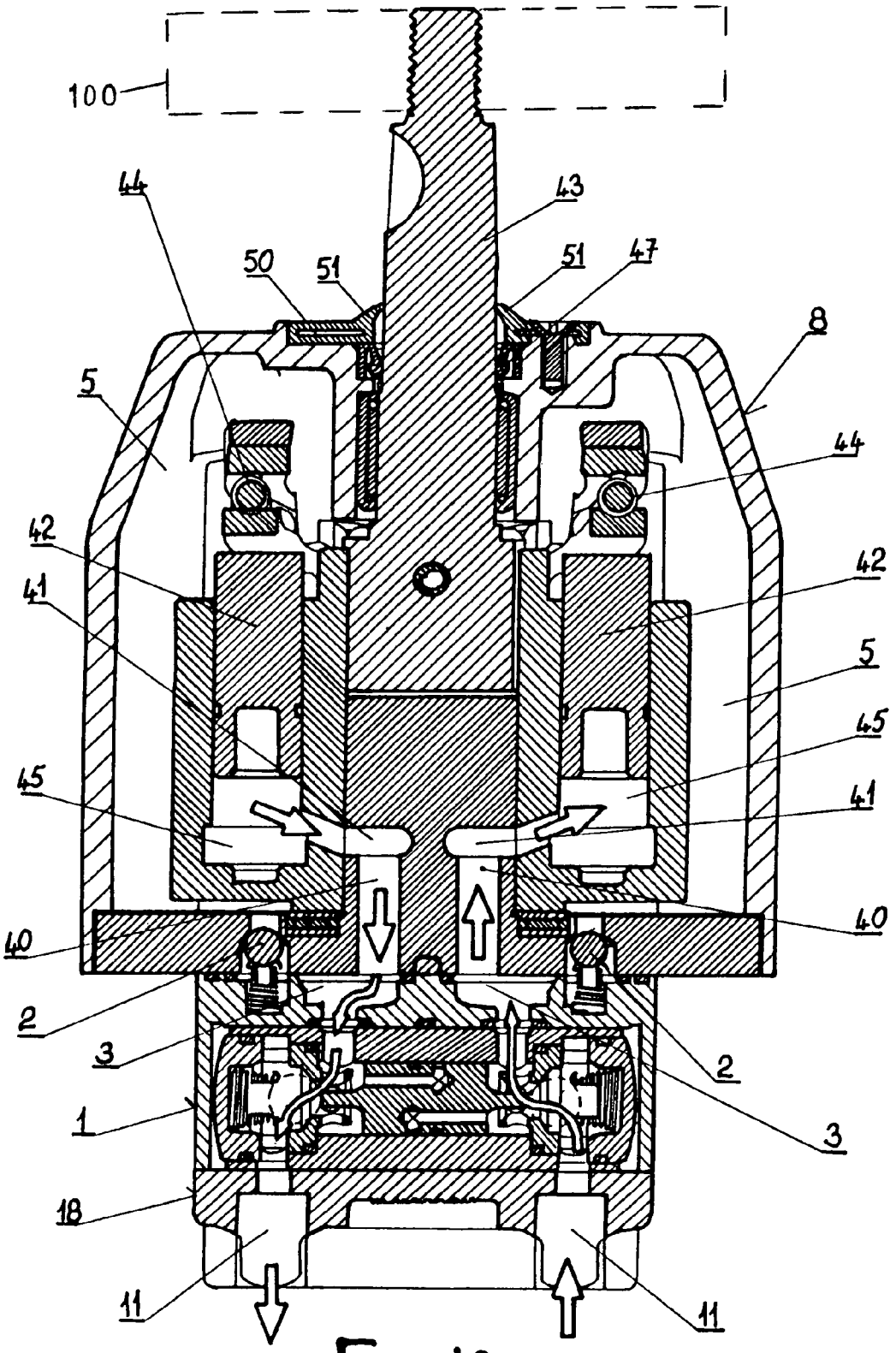
FIG. 19 shows the central vertical section of the oil pressure pump assembly with the relevant valve set and seal on the steering wheel shaft according to this invention.

For information purposes, most of the elements previously described are assembled in FIG. 19 in order to explain how the pump in question is operating. The part of the pump 8 to be secured to the valve set 1 is flange shaped 39, featuring two ducts 40 matching the disaligned recesses 3 and the ducts 6 of the valve housing 1. The ducts 40 communicate by two separate radial and opposed recesses 41 with the chambers 45 of the pump pistons 42.

As is known, the steering wheel 100 (FIG. 19) is mounted at the external end of the shaft 43 of this pump. By means of a cam device 44, the said shaft 43 drives several small pistons 42 for intake or compression of the oil in their chambers 45 as illustrated by the arrows, thus filling or emptying the chambers of the oil pressure operated cylinder driving the engine or steering gear of the boat.

This lower end of this flange 39 closes the bottom of the oil tank 5 and features through holes 46 for the feed valves 2 of the equipment.

The oil taken in or compressed by the pump pistons is conveyed through the threaded fitting 11 in connection with the chambers of the flow dynamic cylinder and thus reaches the ball valve 26. The fluid, pressurized in one of the cylinder chambers (at the left in FIG. 19), pushes the ball valve 26 outwards and the plunger 27 in the opposite direction, thus pushing with its shank 28 the opposite ball valve 26 causing it to open and let the return fluid flow from the other cylinder chamber. This is achieved by turning the wheel in a given direction, whereas the inlet and return flows of the oil will be reversed when turning the wheel in the opposite direction, causing a similar reversed operation of the valve set. By the way, the ball valves 26 are at rest in closed position when the wheel is not moved, thus creating a set of non-return valves and this is particularly important to keep the engine or the rudder of the boat stopped, without any undesired movement of the engine or rudder in either direction.

The above described oil pressure operated pump features a valve set directly secured to the pump, but it is also possible to keep this valve set separated from the pump, but in such case, proper ducts shall be provided for connection to the pump and to the cylinder, as well as an element in which to lodge the suction valve connected to the inner part of the tank 5. The pump is provided with a seal 47 of any type such as a Corteco or O-ring fitted between the wheel shaft 43 and the pump casing 8 to prevent dust or fluids from entering the pump.

According to this invention, this seal 47 is easy to install, to fix, to remove and to replace, by means of the cap 48 provided with holes 49 through which to pass the fastening screws and fitted with a metal or thermoplastic insert 50. The outer edge 51 of this cap 48 has the shape of an inwards turned peak adherent to the wheel shaft 43, thus creating a perfect seal between the shaft and the outer pump walls.

Obviously, the invention here generally described, but without limiting, may be subject to variations and adjustments; some of its parts may be replaced by others having the same aims, based upon the various circumstances and on the nature of the oil pressure operated control pump.

What is claimed is:

1. An oil pressure operated pump for marine steering gears comprising:

a) a multiple piston oil pressure operated pump controlled by a steering wheel connected with a mobile shaft, the multiple piston oil pressure operated pump including a double acting oil pressure cylinder acting in response to movement of the mobile shaft for controlling a direction of an engine or rudder of a boat, b) a valve housing mounted under the multiple piston oil pressure operated pump, c) a bottom cover closing the valve housing from below, d) the valve housing and the cover each including:

i) channels, ii) threaded holes for reciprocal fastening of the valve housing and cover together and for fastening of the valve housing to the multiple piston oil pressure operated pump by bolts, iii) non-threaded bores for oil pressure connections, iv) each of said cover and valve housing being obtained by one of:

A) pressure die-casting in one of an aluminium alloy and zinc alloy, and

B) pressure molding in a thermoplastic material, e) a valve set lodged in the valve housing for non-return and adjustment of oil flow, the valve set including:

i) a generally parallelepiped shaped tubular shell fit in said valve housing and having:

A) a generally square shape about a periphery thereof in traverse cross-section, B) a central tubular through-hole, and C) lathe-turned ducts, ii valves mounted in the tubular shell for controlling fluid flow to the double acting oil pressure cylinder and thereby movement of the shaft, in such a manner that the valve set with the valves assembled therewith can be inserted into and removed from the valve housing as a unitary element.

2. An oil pressure operated pump as described in claim 1, wherein the valve housing includes ducts in the at least one surface recess for oil supply to and suction from the valve set.

3. An oil pressure operated pump as described in claim 1, wherein the valve housing includes:

a surface recess, a first duct in open communication with the surface recess and branched to an oil tank of the multiple piston oil pressure operated pump, and a hole for pressure compensation and balancing of pressure in the valve set, said hole being in open fluid communication with the surface recess.

4. An oil pressure operated pump as described in claim 1, further comprising second and third ducts in the valve housing for pressure compensation and balancing and which together permit installation of at least two oil pressure operated pumps, each provided with a wheel located in different parts of a boat.

5. An oil pressure operated pump as described in claim 1, further comprising centering dowels for further assembling the valve housing to the multiple piston oil pressure operated pump and to the bottom cover, with said centering dowels being fitted in respective bores in the valve housing, the multiple piston oil pressure operated pump and the bottom cover.

6. An oil pressure operated pump as described in claim 1, wherein:

the valves in the tubular shell include two ball valves, each having:

a ball, a seat, and a thrust spring having one end located against the seat and an opposite end for biasing the ball, the valve set further includes a movable plunger provided with shanks at opposite ends which rest against the balls so that the ball valves and the movable plunger act as non-return valves to prevent oil from flowing back when the wheel is at rest and to control the supply and discharge of cylinder chambers of the multiple piston oil pressure operated pump.

7. An oil pressure operated pump as described in claim 1, wherein:

the valves in the tubular shell include two ball valves, the valve housing includes two ducts, and the valve set further includes two axially centered radial ducts communicating with the two ducts of the valve housing to permit oil to be conveyed from the multiple piston oil pressure operated pump to the ball valves.

8. An oil pressure operated pump as described in claim 1, wherein the bottom cover includes an upper surface with two first ducts matching first radial ducts of the valve set, with said two first ducts terminating at lower ends thereof with threaded holes connected by fittings to chambers of an oil pressure operated cylinder.

9. An oil pressure operated pump as described in claim 8, wherein other ducts adjacent to the first ducts of the bottom cover are located in the bottom cover, the other ducts being connected through a surface recess in the bottom cover to ducts associated with the relief valves in the valve housing and fluidly connected to an oil tank of the multiple piston oil pressure operated pump.

10. An oil pressure operated pump as described in claim 1, wherein the bottom cover includes channels provided with threaded holes and connected to ducts in the valve housing which link oil tanks of several pumps if multiple steering wheels are located in different places on a boat.

11. An oil pressure operated pump as described in claim 1, wherein the multiple piston oil pressure operated pump includes a lower flange having two ducts which match surface recesses and ducts in the valve housing, the two ducts also communicating, by means of two separate, radial opposed recesses in the lower flange with chambers of pistons of the multiple piston oil pressure operated pump.

12. An oil pressure operated pump as described in claim 11, wherein:

the valve housing includes:

an upper surface, at least one surface recess in the upper surface, and two small valves lodged in the at least one surface recess, and the lower flange has two holes through which valve heads of the two small valves protrude into a pump tank of the multiple piston oil pressure operated pump.

13. An oil pressure operated pump for marine steering gears comprising:

a) a multiple piston oil pressure operated pump controlled by a steering wheel connected with a mobile shaft, the multiple piston oil pressure operated pump including a double acting oil pressure cylinder acting in response to movement of the mobile shaft for controlling a direction of an engine or rudder of a boat, b) a valve housing mounted under the multiple piston oil pressure operated pump, the valve housing including:
i) an upper surface,
ii) at least one surface recess in the upper surface,
iii) two tabs in the at least one surface recess,
iv two small valves lodged in the at least one surface recess, each small valve penetrating into an oil tank of the multiple piston oil pressure operated pump for filling the multiple piston oil pressure operated pump and for topping up the oil when necessary,
c) a bottom cover closing the valve housing from below,
d) the valve housing and the cover each including:
i) channels,
ii) threaded holes for reciprocal fastening of the valve housing and cover together and for fastening of the valve housing to the multiple piston oil pressure operated pump by bolts,
iii) non-threaded bores for oil pressure connections,
iv) each of said cover and valve housing being obtained by one of:
A) pressure die-casting in one of an aluminium alloy and zinc alloy, and
B) pressure molding in a thermoplastic material,
e) a valve set lodged in the valve housing for non-return and adjustment of oil flow, the valve set including:
i) a generally parallelepiped shaped tubular shell having:
A) a generally square shape about a periphery thereof in transverse cross-section,
B) a central tubular through-hole, and
C) lathe-turned ducts,
ii) valves in the tubular shell for controlling fluid flow to the double acting oil pressure cylinder and thereby movement of the shaft.

14. An oil pressure operated pump for marine steering gears comprising:
a) a multiple piston oil pressure operated pump controlled by a steering wheel connected with a mobile shaft, the multiple piston oil pressure operated pump including a double acting oil pressure cylinder acting in response to movement of the mobile shaft for controlling a direction of an engine or rudder of a boat,
b) a valve housing mounted under the multiple piston oil pressure operated pump, the valve housing including two relief valves located therein and which are connected by ducts in the valve housing to branch pipes of two chambers of the oil pressure operated cylinder for controlling the direction of the engine or rudder of the boat,
c) a bottom cover closing the valve housing from below,
d) the valve housing and the cover each including:
i) channels,
ii) threaded holes for reciprocal fastening of the valve housing and cover together and for fastening of the valve housing to the multiple piston oil pressure operated pump by bolts,
iii) non-threaded bores for oil pressure connections,
iv) each of said cover and valve housing being obtained by one of:
A) pressure die-casting in one of an aluminium alloy and zinc alloy, and
B) pressure molding in a thermoplastic material,
e) a valve set lodged in the valve housing for non-return and adjustment of oil flow, the valve set including:
i) a generally parallelepiped shaped tubular shell having:
A) a generally square shape about a periphery thereof in transverse cross-section,
B) a central tubular through-hole, and
C) lathe-turned ducts,
ii) valves in the tubular shell for controlling fluid flow to the double acting oil pressure cylinder and thereby movement of the shaft.

15. An oil pressure operated pump for marine steering gears comprising:
a) a multiple piston oil pressure operated pump controlled by a steering wheel connected with a mobile shaft, the multiple piston oil pressure operated pump including a double acting oil pressure cylinder acting in response to movement of the mobile shaft for controlling a direction of an engine or rudder of a boat,
b) a valve housing mounted under the multiple piston oil pressure operated pump,
c) a bottom cover closing the valve housing from below,
d) the valve housing and the cover each including:
i) channels,
ii) threaded holes for reciprocal fastening of the valve housing and cover together and for fastening of the valve housing to the multiple piston oil pressure operated pump by bolts,
iii) non-threaded bores for oil pressure connections,
iv) each of said cover and valve housing being obtained by one of:
A) pressure die-casting in one of an aluminium alloy and zinc alloy, and
B) pressure molding in a thermoplastic material,
e) a valve set lodged in the valve housing for non-return and adjustment of oil flow, the valve set including:
i) a generally parallelepiped shaped tubular shell having:
A) a generally square shape about a periphery thereof in traverse cross-section,
B) a central tubular through-hole, and
C) lathe-turned ducts,
ii) valves in the tubular shell for controlling fluid flow to the double acting oil pressure cylinder and thereby movement of the shaft, the valves in the tubular shell including two ball valves, and
iii) two radial ducts to permit oil to be conveyed from the ball valves to the bottom cover.

16. An oil pressure operated pump for marine steering gears comprising:
a) a multiple piston oil pressure operated pump controlled by a steering wheel connected with a mobile shaft, the multiple piston oil pressure operated pump including a double acting oil pressure cylinder acting in response to movement of the mobile shaft for controlling a direction of an engine or rudder of a boat,
b) a valve housing mounted under the multiple piston oil pressure operated pump, the valve housing including:
i) a surface recess,
ii) a first duct in open communication with the surface recess and branched to an oil tank of the multiple piston oil pressure operated pump, and
iii) a hole for pressure compensation and balancing of pressure in the valve set, said hole being in open fluid communication with the surface recess, c) a bottom cover closing the valve housing from below, d) the valve housing and the cover each including:

i) channels, ii) threaded holes for reciprocal fastening of the valve housing and cover together and for fastening of the valve housing to the multiple piston oil pressure operated pump by bolts, iii) non-threaded bores for oil pressure connections, iv) each of said cover and valve housing being obtained by one of:

A) pressure die-casting in one of an aluminium alloy and zinc alloy, and

B) pressure molding in a thermoplastic material, e) a valve set lodged in the valve housing for non-return and adjustment of oil flow, the valve set including:

i) a generally parallelepiped shaped tubular shell having:

A) a generally square shape about a periphery thereof in transverse cross-section, B) a central tubular through-hole, and C) lathe-turned ducts, ii) valves in the tubular shell for controlling fluid flow to the double acting oil pressure cylinder and thereby movement of the shaft, and iii) the movable plunger including ducts and two circumferential channels, and iv) the tubular shell of the valve set includes a raceway branched off inside the tubular shell in a misaligned radial, position, the raceway being connected by the ducts and two circumferential channels of the plunger to the hole of the valve housing which is fluidly connected through the surface recess and the first duct to the oil tank of the multiple piston oil pressure operated pump in order to discharge any over-pressure built up in the valve set so as to balance the quantity of oil in delivery and return lines of pumping pistons and to discharge any surplus in the oil tank when the cylinder fed by the multiple piston oil pressure operated pump is unbalanced in different chambers.

17. An oil pressure operated pump for marine steering gears, comprising:

a multiple piston oil pressure operated pump, a shaft protruding from the multiple piston oil pressure operated pump and on which a steering wheel is mounted, the shaft extending along an axis, a seal fitted between the shaft and a casing of the multiple piston oil pressure operated pump, to prevent dust and liquid from entering the multiple piston oil pressure operated pump, and a cap removably locking in the seal, the cap including:

holes through which fixing screws are adapted to pass, and an inner edge which is peak shaped so as to have a substantially frusto-conical cross-section that extends at an angle between said axis and a plane perpendicular to said axis, resting and sliding on the shaft for sealing of the shaft on the oil pressure operated pump.

* * * * *